US007601221B2

(12) United States Patent
Brisberger et al.

(10) Patent No.: US 7,601,221 B2
(45) Date of Patent: Oct. 13, 2009

(54) DEVICE FOR HOT-DIP COATING A METAL BAR

(75) Inventors: Rolf Brisberger, Issum (DE); Bodo Falkenhahn, Ratingen (DE); Holger Behrens, Erkrath (DE); Michael Zielenbach, Siegen (DE); Bernhard Tenckhoff, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 58 days.

(21) Appl. No.: 10/535,771

(22) PCT Filed: Oct. 25, 2003

(86) PCT No.: PCT/EP03/11890

§ 371 (c)(1),
(2), (4) Date: Oct. 24, 2005

(87) PCT Pub. No.: WO2004/048633

PCT Pub. Date: Jun. 10, 2004

(65) Prior Publication Data

US 2006/0137605 A1 Jun. 29, 2006

(30) Foreign Application Priority Data

Nov. 22, 2002 (DE) ..... 102 54 513

(51) Int. Cl.
*B05C 3/02* (2006.01)

(52) U.S. Cl. ..... 118/405; 118/419

(58) Field of Classification Search ..... 118/419, 118/405, 125; 164/461, 419, 498, 147.1; 222/597, 599

See application file for complete search history.

(56) References Cited

U.S. PATENT DOCUMENTS

| | | | | | |
|---|---|---|---|---|---|
| 3,470,939 | A | * | 10/1969 | Coad | 164/505 |
| 3,521,696 | A | * | 7/1970 | Lowman et al. | 164/450.2 |
| 3,568,753 | A | * | 3/1971 | Clarke | 164/461 |
| 3,605,862 | A | * | 9/1971 | Schultz et al | 164/449.1 |
| 3,666,537 | A | * | 5/1972 | Williams | 427/295 |
| 4,479,530 | A | * | 10/1984 | Ekerot | 164/461 |
| 6,106,620 | A | * | 8/2000 | Morrison et al. | 118/429 |

FOREIGN PATENT DOCUMENTS

| | | |
|---|---|---|
| EP | 0 855 450 | 7/1998 |
| FR | 2 804 443 | 8/2001 |

* cited by examiner

*Primary Examiner*—Brenda A Lamb
(74) *Attorney, Agent, or Firm*—Friedrich Kueffner

(57) ABSTRACT

The invention relates to a device for hot-dip coating a metal bar (1), particularly a steel strip, in which the metal bar (1) is vertically directed through a container (3) receiving the molten coating metal (2) and a directing channel (4) that is arranged upstream thereof. Said device comprises at least two inductors (5) which are disposed on both sides of the metal bar (1) in the zone of the directing channel (4) and generate an electromagnetic field for retaining the coating metal (2) within the container (3). In order to better control the coating process, the inventive device is characterized by a sealing means (7, 7') which is arranged above the directing channel (4) in the bottom area (6) of the container (3) and alternatively releases or interrupts the flow of molten coating metal (2) to the metal bar (1) and/or the directing channel (4).

7 Claims, 3 Drawing Sheets

DEVICE FOR HOT-DIP COATING A METAL BAR

The invention concerns a device for hot dip coating a metal strand, especially a steel strip, in which the metal strand is passed vertically through a coating tank that contains the molten coating metal and through a guide channel upstream of the coating tank, with at least two inductors for generating an electromagnetic field, which are installed on both sides of the metal strand in the area of the guide channel in order to keep the coating metal in the coating tank.

Conventional metal hot dip coating installations for metal strip have a high-maintenance part, namely, the coating tank and the fittings it contains. Before being coated, the surfaces of the metal strip must be cleaned of oxide residues and activated for bonding with the coating metal. For this reason, the strip surfaces are subjected to heat treatments in a reducing atmosphere before the coating operation is carried out. Since the oxide coatings are first removed by chemical or abrasive methods, the reducing heat treatment process activates the surfaces, so that after the heat treatment, they are present in a pure metallic state.

However, this activation of the strip surfaces increases their affinity for the surrounding atmospheric oxygen. To prevent the surface of the strip from being reexposed to atmospheric oxygen before the coating process, the strip is introduced into the hot dip coating bath from above in an immersion snout. Since the coating metal is present in the molten state, and since one would like to utilize gravity together with blowing devices to adjust the coating thickness, but the subsequent processes prohibit strip contact until the coating metal has completely solidified, the strip must be deflected in the vertical direction in the coating tank. This is accomplished with a roller that runs in the molten metal. This roller is subject to strong wear by the molten coating metal and is the cause of shutdowns and thus loss of production.

The desired low coating thicknesses of the coating metal, which vary in the micrometer range, place high demands on the quality of the strip surface. This means that the surfaces of the strip-guiding rollers must also be of high quality. Problems with these surfaces generally lead to defects in the surface of the strip. This is a further cause of frequent plant shutdowns.

To avoid the problems associated with rollers running in the molten coating metal, approaches have been proposed, in which a coating tank is used that is open at the bottom and has a guide channel in its lower section for guiding the strip vertically upward, and in which an electromagnetic seal is used to seal the open bottom of the coating tank. The production of the electromagnetic seal involves the use of electromagnetic inductors, which operate with electromagnetic alternating or traveling fields that seal the coating tank at the bottom by means of a repelling, pumping, or constricting effect.

A solution of this type is described, for example, in EP 0 673 444 B1. The solution described in WO 96/03,533 and the solution described in JP 50[1975]-86,446 also provide for an electromagnetic seal for sealing the coating tank at the bottom.

In this regard, guaranteeing the tightness of the seal of the coating tank guide channel, which is open at the bottom, is an important and difficult problem, above all in an emergency situation in which the electromagnetic seal may fail due to a power outage. Various possibilities for dealing with this situation have been disclosed in the prior art.

EP 0 630 421 B1 provides for a constriction below the guide channel, from which a pipe leads to a reservoir for molten coating metal. This document does not disclose detailed information on the design of this device, which is referred to as a reflux barrier.

JP 2000-273,602 discloses a collecting tank below the guide channel, which is intended to collect coating metal that runs down through the guide channel. The coating metal is conveyed to a tank, from which it is pumped back into the coating tank by a pump. Here again, no definite and specific information is provided about how the coating metal that runs out is to be collected.

EP 0 855 450 B1 deals in greater detail with the question of how the tightness of the lower region of the guide channel can be guaranteed. It discloses various alternative solutions for guaranteeing this. In one embodiment, two slides installed on either side of the metal strand can be moved up to the surface of the metal strand perpendicularly to the metal strand. The slides act as plugs and, when necessary, are held in contact with the metal strand to prevent molten metal from escaping down through the guide channel. However, relatively expensive automatic control of the slides is necessary to guarantee their function. In another embodiment, a belt conveyor is used, which conveys the escaping coating metal from the area below the guide channel to a collecting tank. However, this solution is very expensive and entails the risk that the belt will become clogged with coating metal in the course of time and thus will no longer be able to function properly. A third alternative solution for preventing the escape of molten coating metal involves the use of a gas jet system. A stream of gas is directed at the guide channel from below, which is intended to force the escaping coating metal back up and thus seal the opening of the guide channel at the bottom. This solution is also expensive and has limited practical suitability.

FR 2 798 396 A discloses a hot dip coating installation in which a barrier is arranged in the bottom area of the coating tank at the transition to the guide channel. This is intended to keep molten metal in the coating channel from entering the guide channel. To this end, the barrier is equipped with walls or deflectors that are designed for favorable flow. However, the barrier disclosed in this document is not suitable for keeping the molten coating metal out of the area of the guide channel in emergency situations. Similarly, the coating process cannot be influenced with this barrier.

EP 0 855 450 A1 describes a solution in which a temporary seal between the molten metal in the coating tank and the guide channel is produced with a seal that consists of a fusible material whose melting point is no higher than that of the coating metal. After this seal has melted, the fluid connection between the molten metal in the coating tank and the guide channel is established.

Therefore, the objective of the invention is to develop a device for hot dip coating of a metal strand, with which it is possible to conduct the coating process in an optimum way and also by simple means to guarantee reliable operation of the installation in critical operating states, for example, if the inductor power supply is interrupted.

The solution of this problem in accordance with the invention is characterized by sealing means arranged above the guide channel in the bottom area of the coating tank for selectively releasing or interrupting the flow of molten coating metal to the metal strand and/or to the guide channel, such that the sealing means are designed as a weir that can be moved relative to the bottom area of the coating tank.

In accordance with the invention, the flow of the coating metal, especially to the guide channel, can be selectively released or interrupted, so that, especially in the case of a disruption of the operation, there is no danger that molten metal can escape from the coating installation through the guide channel.

This design makes it possible to avoid damage of the coating installation and economic loss in the event of such a disruption.

In accordance with one embodiment, the weir has two interacting parts, each of which can be moved perpendicularly to the surface of the metal strand. Alternatively or additionally, it can be provided that the weir can be moved in the direction of conveyance of the metal strand.

In the latter case, it can be provided that the weir is formed as a single piece and has the form of a box. This makes it possible both to produce the weir inexpensively and to guarantee the operational suitability of the device in an especially simple way.

It is advantageous for the weir to have covering means in its upper end region that face away from the bottom area of the coating tank. These covering means make it possible to quiet the coating bath, into which turbulence is introduced by the electromagnetic excitation produced by the inductors. In one embodiment, the covering means are designed as wall sections that extend parallel to the bottom area of the coating tank. In another embodiment, the covering means are designed as a plate that has a slot-like opening for the passage of the metal strand.

The sealing means, especially the weir, are preferably connected with manual, pneumatic or hydraulic operating mechanisms. In this regard, the operating mechanisms can be connected with an installation control system, which effects the release or interruption of the flow of molten coating metal to the metal strand and/or to the guide channel.

Embodiments of the invention are illustrated in the drawings.

FIG. 1 shows a schematic section through a hot dip coating device with a metal strand 1 being guided through it.

Figure 1:
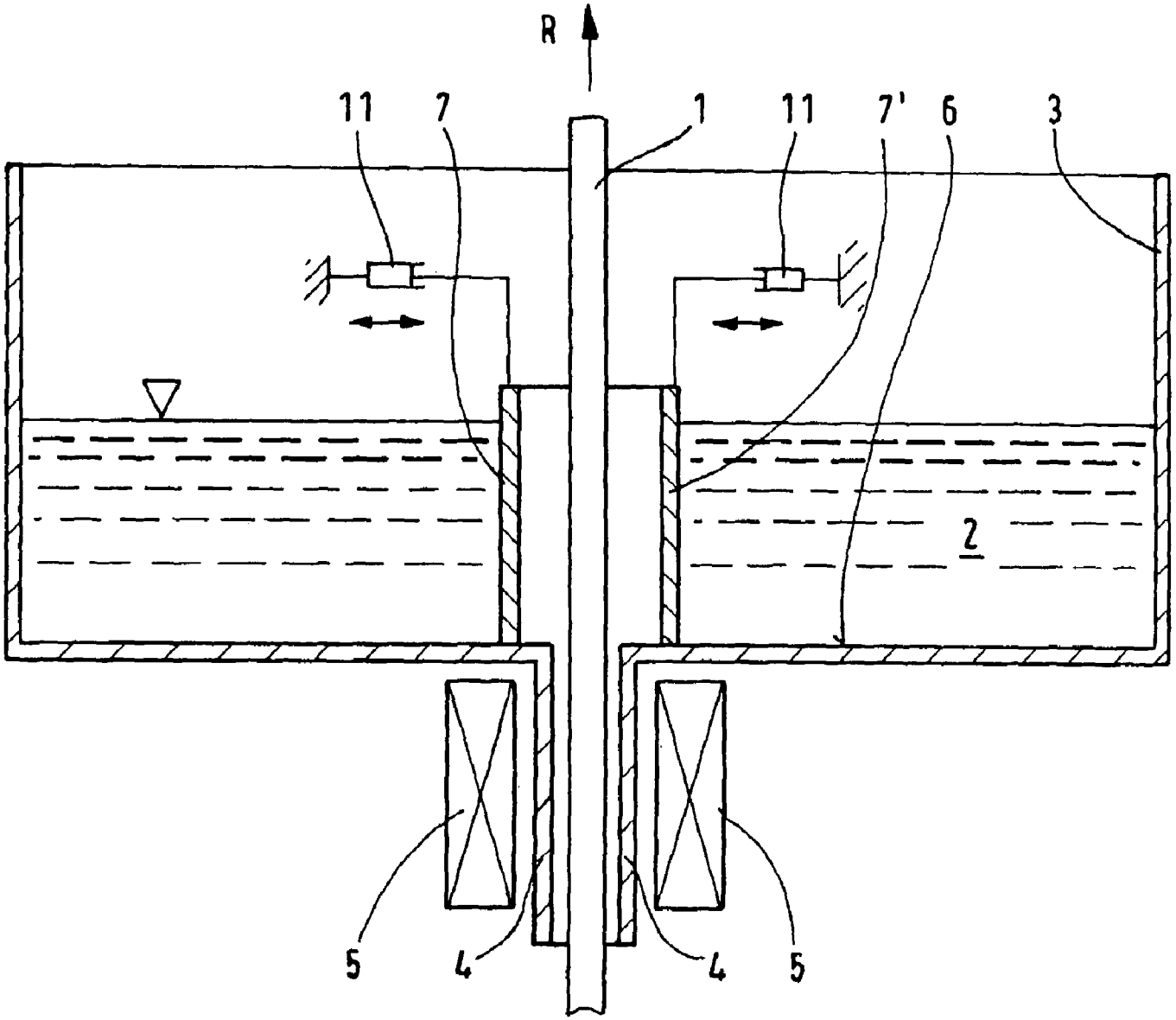
FIG. 1 shows a schematic section through a hot dip coating device with a metal strand being guided through it.

The device has a coating tank 3, which is filled with molten coating metal 2. The coating metal 2 can be, for example, zinc or aluminum. The metal strand 1 in the form of a steel strip passes vertically upward through the coating tank 3 in conveying direction R. It should be noted at this point that it is also basically possible for the metal strand 1 to pass through the coating tank 3 from top to bottom. To allow passage of the metal strand 1 through the coating tank 3, the latter is open at the bottom, where a guide channel 4 is located.

To prevent the molten coating metal 2 from flowing out at the bottom through the guide channel 4, two electromagnetic inductors 5 are located on either side of the metal strand 1. The electromagnetic inductors 5 generate a magnetic field, which counteracts the weight of the coating metal 2 and thus seals the guide channel 4 at the bottom.

The inductors 5 are two alternating-field or traveling-field inductors installed opposite each other. They are operated in a frequency range of 2 Hz to 10 kHz and create an electromagnetic transverse field perpendicular to the conveying direction R. The preferred frequency range for single-phase systems (alternating-field inductors) is 2 kHz to 10 kHz, and the preferred frequency range for polyphase systems (e.g., traveling-field inductors) is 2 Hz to 2 kHz.

In the embodiment shown in FIG. 1, a two-part sealing means 7, and 7' in the form of a weir is installed in the bottom area (6) of the coating tank 3. The two parts 7, 7' of the weir can be moved parallel to the bottom of the coating tank 3 in the direction of the double arrow. This movement is accomplished with operating mechanisms 11, which are illustrated here only schematically as piston-cylinder units; any other type of operating mechanism 11 can be used in the same way.

In the present case, the weir 7 and 7' is constructed as a two-part box. The two halves 7 and 7' can interact in such a way that they partition off the region of the guide channel 4 in the bottom area 6 of the coating tank 3. This situation is shown in FIG. 1. Consequently, the coating metal 2 cannot reach the guide channel 4 or the metal strand 1. This closed position of the weir 7 and 7' is important especially in two operating states:

First, this position is assumed before the coating installation is brought to full speed. The metal strand 1 is then moving upward in conveying direction R (without coating metal 2 being able to reach it), and the inductors 5 are activated. Only then are the two parts 7 and 7' of the weir moved away from the metal strand 1 in the direction of the double arrow, so that coating metal 2 can pass through the opening box and reach the metal strand 1 and the area of the guide channel 4. Since the inductors 5 are activated, the coating metal 2 cannot escape downward through the guide channel 4. Therefore, the weir 7, 7' initially encloses the guide channel 4, which is open at the bottom, and thus the metal strand 1 passing through the guide channel up to an optimized height above the bottom area 6 of the coating tank 3, so that no coating metal 2 can flow towards the guide channel 4. When the coating process is begun, the weir 7, 7' is then opened, so that the coating metal 2 can flow, in a way that is optimized with respect to time and volume, to the metal strand 1 and thus into the guide channel 4, which, however, is now electromagnetically sealed by the inductors 5.

Second, the weir 7, 7' is also important when a power failure occurs, and the inductors 5 (e.g., until an emergency power system starts up) are no longer able to perform their function, namely, to seal the guide channel at the bottom by the electromagnetic field they generate. In this case, the two parts 7, 7' of the weir are moved towards the metal strand 1 in the direction of the double arrow until they touch and form the box-shaped covering around the metal strand 1. Consequently, coating metal 2 can no longer reach the metal strand 1 and the guide channel 4, i.e., the guide channel 4 is now mechanically sealed. This prevents coating metal 2 from flowing down and out of the guide channel 4.

Figure 2:
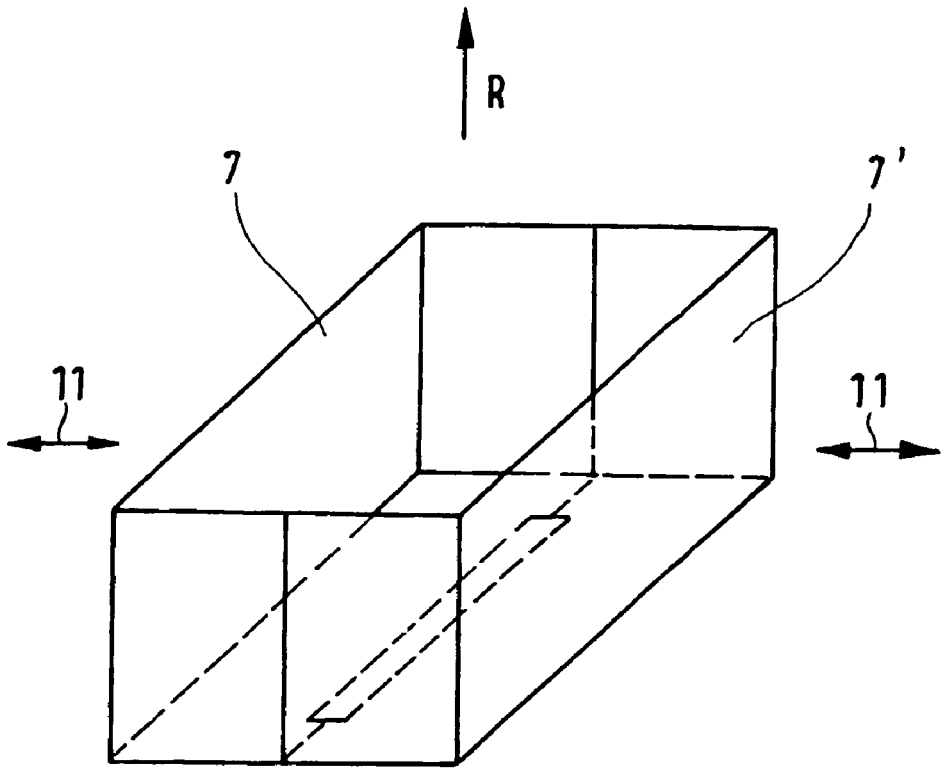
FIG. 2 shows a perspective view of a weir constructed from two pieces.

In FIG. 2, the weir 7, 7' is shown again in a perspective view in its closed state. The double arrows indicate the direction in which the two parts 7, 7' of the weir can be moved relative to the conveying direction R of the metal strand 1. This movement is effected by the operating mechanisms 11 (see FIG. 1). The drawing shows that there is an opening for the passage of the metal strand 1 in the bottom of the weir 7, 7'. However, in the illustrated closed position of the weir 7, 7', it is ensured that no coating metal 2 can reach the metal strand 1 and the guide channel 4.

Figure 3:
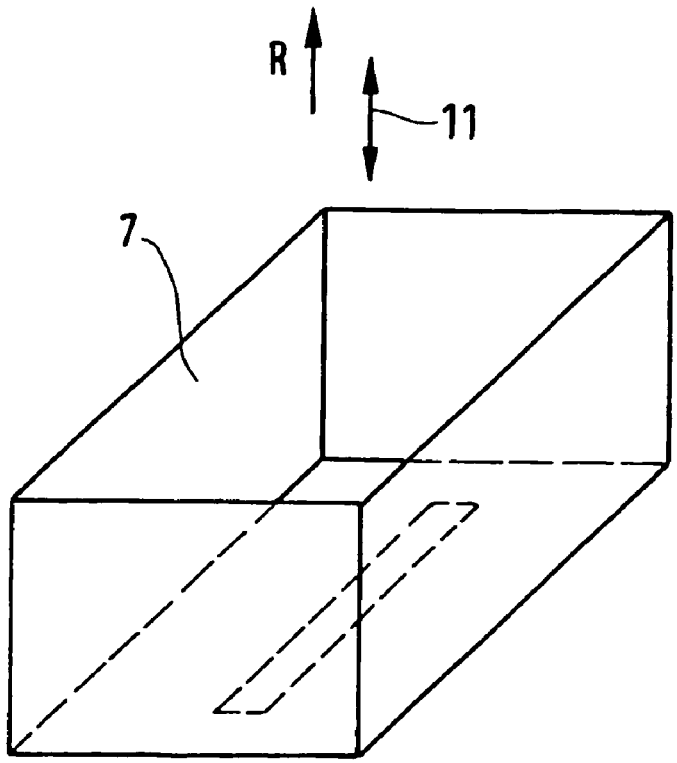
FIG. 3 shows a perspective view of a weir constructed as a single piece.

Since the weir 7, 7' is exposed to the coating metal 2, it is advantageous for stable and reliable operation of the weir 7, 71 if it consists of as few individual parts as possible. Whereas the embodiment shown in FIGS. 1 and 2 consists of a two-part weir 7, 7', FIG. 3 shows that the weir 7 can also be constructed as a single piece. In this case, in its closed state, the box-shaped weir 7 rests on the bottom 6 of the coating tank 3 and thus seals the guide channel 4. The weir 7 is opened by moving it vertically upward, i.e., in conveying direction R, by operating mechanisms 11.

To carry out a coating process for producing a qualitatively high-grade coated metal strand, it is advantageous if care is taken to ensure that the surface of the coating bath remains as calm as possible. This is not inherently guaranteed, because the electromagnetic inductors 5 induce flow in the coating metal 2 by the magnetic fields that they generate.

Figure 4:
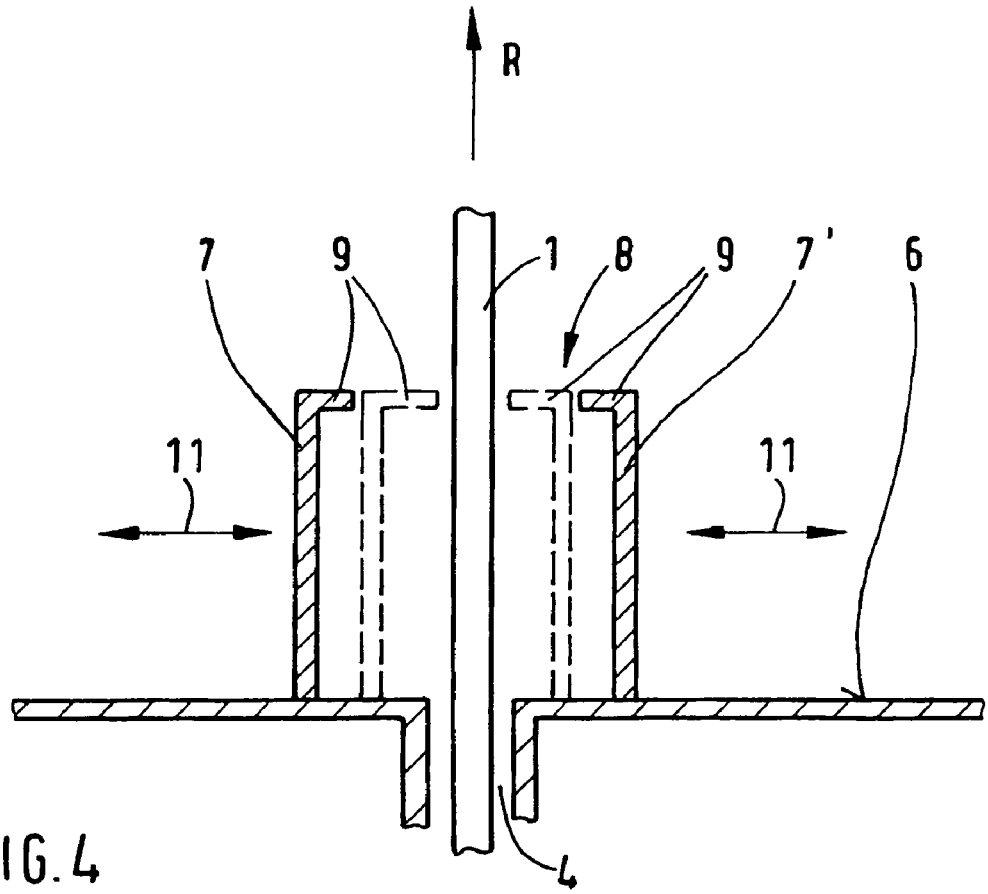
FIG. 4 shows a schematic section through the hot dip coating device with a weir that is constructed from two pieces and equipped with covering means.

In the embodiment shown in FIG. 4, to quiet the surface of the coating bath, covering means 9 are provided in the end region 8 of the weir 7, 7', which ensure that the currents induced by the inductors 5 cannot spread farther in the direction of the surface of the bath.

The turbulence of the molten coating metal 2 produced in the guide channel 4 and in the coating tank 3 by the electromagnetic seal can be shielded by the design of the weir 7, 7' and especially by the cover 9.

Figure 5:
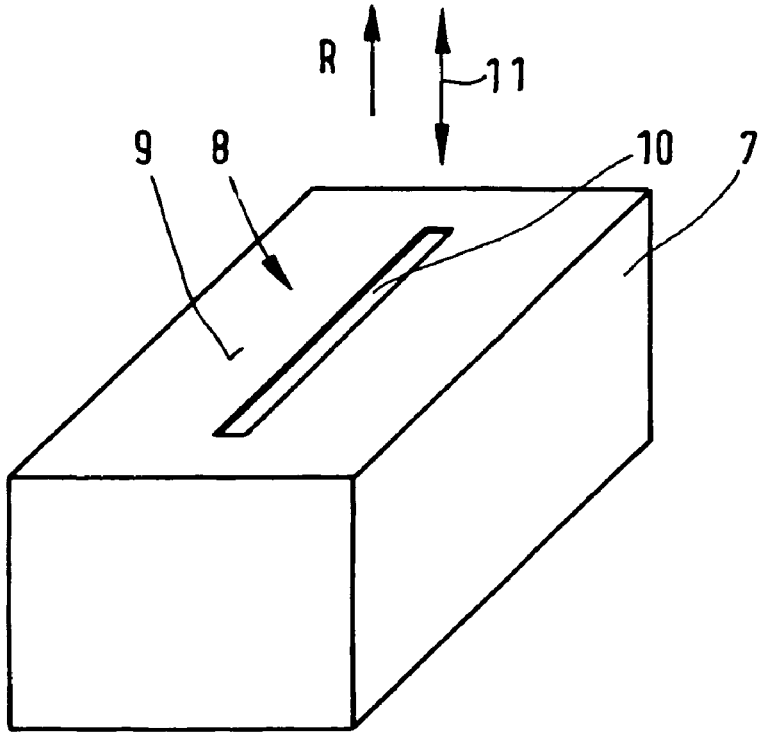
FIG. 5 shows a perspective view of a weir that is constructed as a single piece and equipped with covering means.

When the weir 7 is constructed as a single piece, the possibility shown in FIG. 5 is realized: In this case, the weir 7 is provided with an opening 10 at the top to allow the metal strand 1 to pass through. The currents induced in the coating metal 2 by the inductors 5 are stopped here by the covering means 9, which produce almost complete isolation of the interior of the weir 7 from the rest of the coating bath. This design makes it possible to achieve optimum quieting of the bath surface and thus to ensure a quality coating.

In the event of an operational disruption and especially in the event of failure of the electromagnetic inductors 5, the weir 7 is closed by the operating mechanisms 11, so that there is no danger of the coating metal 2 escaping from the coating tank 3.

LIST OF REFERENCE SYMBOLS

1 metal strand (steel strip)
2 coating metal
3 coating tank
4 guide channel
5 inductor
6 bottom area of the coating tank
7 sealing means
7' sealing means
8 end region of the sealing means
9 covering means
10 opening
11 operating mechanism
R conveying direction

The invention claimed is:

1. Device for hot dip coating a metal strand (1), said device comprising a tank (3) that contains the molten coating metal (2) and an upstream guide channel (4) such that a metal strand (1) can be guided vertically through the guide channel (4) and the tank (3) thereby coating the metal strand (1) with at least two inductors (5) for generating an electromagnetic field, which are installed on both sides of the metal strand (1) in the area of the guide channel (4) in order to keep the coating metal (2) in the coating tank (3), comprising sealing means (7, 7') arranged above the guide channel (4) in the bottom area (6) of the coating tank (3), wherein the sealing means (7, 7') can be positioned in a first position, in which the molten coating metal (2) can be released to flow to the metal strand (1) and/or to the guide channel (4), and in a second position, in which the flow of molten coating metal (2) to the metal strand (1) and/or to the guide channel (4) can be interrupted, and wherein the sealing means (7, 7') are designed as a weir that can be moved relative to the bottom area (6) of the coating tank (3), wherein the weir has two interacting parts (7, 7'), and further comprising operating mechanisms (11) operative to move the parts (7, 7') perpendicular to the surface of the metal strand (1) and to the direction of conveyance of the metal strand and parallel to the bottom wall of the coating tank (3).

2. Device for hot dip coating a metal strand (1), said device comprising a tank (3) that contains the molten coating metal (2) and an upstream guide channel (4) such that a metal strand (1) can be guided vertically through the guide channel (4) and the tank (3) thereby coating the metal strand (1), with at least two inductors (5) for generating an electromagnetic field, which are installed on both sides of the metal strand (1) in the area of the guide channel (4) in order to keep the coating metal (2) in the coating tank (3), comprising sealing means (7, 7') arranged above the guide channel (4) in the bottom area (6) of the coating tank (3), wherein the sealing means (7, 7') can be positioned in a first position, in which the molten coating metal (2) can be released to flow to the metal strand (1) and/or to the guide channel (4), and in a second position, in which the flow of molten coating metal (2) to the metal strand (1) and/or to the guide channel (4) can be interrupted, and wherein the sealing means (7, 71) are designed as a weir that can be moved relative to the bottom area (6) of the coating tank (3), wherein the weir (7, 7') has covering means (9) in its upper end region (8) that face away from the bottom area (6) of the coating tank (3), and further comprising operating mechanisms (11) operative to move the weir (7, 7') perpendicular to the direction of conveyance of the metal strand (1) and parallel to the bottom wall of the coating tank (3).

3. Device in accordance with claim 2, wherein the weir can be moved in the direction of conveyance (R) of the metal strand (1).

4. Device in accordance with claim 2, wherein the covering means (9) are designed as wall sections that extend parallel to the bottom area (6) of the coating tank (3).

5. Device in accordance with claim 2, wherein the covering means (9) are designed as a plate that has a slot-like opening (10) for the passage of the metal strand (1).

6. Device for hot dip coating a metal strand (1), said device comprising a tank (3) that contains the molten coating metal (2) and an upstream guide channel (4) such that a metal strand (1) can be guided vertically through the guide channel (4) and the tank (3) thereby coating the metal strand (1), with at least two inductors (5) for generating an electromagnetic field, which are installed on both sides of the metal strand (1) in the area of the guide channel (4) in order to keep the coating metal (2) in the coating tank (3), comprising sealing means (7, 7') arranged above the guide channel (4) in the bottom area (6) of the coating tank (3), wherein the sealing means (7, 7') can be positioned in a first position, in which the molten coating metal (2) can be released to flow to the metal strand (1) and/or to the guide channel (4), and in a second position, in which the flow of molten coating metal (2) to the metal strand (1) and/or to the guide channel (4) can be interrupted, and wherein the sealing means (7, 7') are designed as a weir that can be moved relative to the bottom area (6) of the coating tank (3), wherein the sealing means (7, 7') are connected with manual, pneumatic or hydraulic operating mechanisms (11), wherein the weir has two interacting parts (7, 7'), each of which can be moved by the operating mechanisms (11) perpendicular to the surface of the metal strand (1), and parallel to the bottom wall of the coating tank (3) as well as up and down in the coating tank (3) along the direction of conveyance of the metal strand (1).

7. Device in accordance with claim 6, wherein the operating mechanisms (11) are connected with an installation control system, which effects the release or interruption of the flow of molten coating metal (2) to the metal strand (1) and/or to the guide channel (4).

* * * * *